US009258863B2

(12) United States Patent
Krishnamoorthy et al.

(10) Patent No.: US 9,258,863 B2
(45) Date of Patent: Feb. 9, 2016

(54) METHOD AND APPARATUS FOR TRIAC APPLICATIONS

(75) Inventors: Ravishanker Krishnamoorthy, Singapore (SG); Siew Yong Chui, Singapore (SG); Jun Li, Singapore (SG)

(73) Assignee: Marvell World Trade Ltd., St. Michael (BB)

( * ) Notice: Subject to any disclaimer, the term of this patent is extended or adjusted under 35 U.S.C. 154(b) by 737 days.

(21) Appl. No.: 13/557,765

(22) Filed: Jul. 25, 2012

(65) Prior Publication Data

US 2013/0043726 A1 Feb. 21, 2013

Related U.S. Application Data

(60) Provisional application No. 61/525,644, filed on Aug. 19, 2011.

(51) Int. Cl.

| | |
|---|---|
| ***H05B 33/08*** | (2006.01) |
| ***H05B 37/02*** | (2006.01) |
| ***H05B 39/08*** | (2006.01) |
| ***H05B 41/392*** | (2006.01) |

(52) U.S. Cl.

CPC ..... *H05B 33/0845* (2013.01); *H05B 37/0272* (2013.01); *H05B 39/08* (2013.01); *H05B 41/392* (2013.01); *Y10T 307/406* (2015.04)

(58) Field of Classification Search

None

See application file for complete search history.

(56) References Cited

U.S. PATENT DOCUMENTS

| | | | | |
|---|---|---|---|---|
| 4,350,935 | A * | 9/1982 | Spira et al. | H05B 41/3924 315/207 |
| 7,091,672 | B2 | 8/2006 | Steffie et al. | |
| 7,446,486 | B2 * | 11/2008 | Steffie et al. | 315/291 |
| 8,492,992 | B2 * | 7/2013 | Otake et al. | 315/291 |
| 2004/0251884 | A1 | 12/2004 | Steffie et al. | |
| 2006/0238139 | A1 | 10/2006 | Steffie et al. | |
| 2006/0244392 | A1 | 11/2006 | Taipale et al. | |
| 2010/0259196 | A1 * | 10/2010 | Sadwick et al. | 315/309 |
| 2011/0074302 | A1 | 3/2011 | Draper et al. | |

FOREIGN PATENT DOCUMENTS

| | | | |
|---|---|---|---|
| CN | 1836193 | A | 9/2006 |
| CN | 101595764 | A | 12/2009 |
| CN | 102036458 | A | 4/2011 |
| WO | WO 2006/118976 | A1 | 11/2006 |

OTHER PUBLICATIONS

U.S. Appl. No. 13/557,265, filed Jul. 25, 2012, by Siew Yong Chui et al., entitled "Start-Up Circuit."

U.S. Appl. No. 13/557,268, filed Jul. 25, 2012, by Siew Yong Chui, entitled "Protection Circuit in Triac Applications."

Combined Office Action and Search Report issued Jan. 29, 2015 in Chinese Patent Application No. 201280049543.1 (with English translation).

International Preliminary Report on Patentability and Written Opinion issued Feb. 25, 2014 in PCT/IB2012/001836.

* cited by examiner

*Primary Examiner* — Rexford Barnie
*Assistant Examiner* — David Shiao

(57) ABSTRACT

Aspects of the disclosure provide a circuit. The circuit includes a control circuit and a return path circuit. The control circuit is configured to operate in response to a first conduction angle of a dimmer coupled to the circuit. The first conduction angle is adjusted to control an output power to a first device. The dimmer has a second conduction angle that is independent of the control of the output power to the first device. The return path circuit is configured to provide a return path to enable providing power to a second device in response to the second conduction angle.

18 Claims, 10 Drawing Sheets

METHOD AND APPARATUS FOR TRIAC APPLICATIONS

INCORPORATION BY REFERENCE

This present disclosure claims the benefit of U.S. Provisional Application No. 61/525,644, "Startup Circuit for Special TRIAC Applications" filed on Aug. 19, 2011, which is incorporated herein by reference in its entirety.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Many electrical and electronic devices are controlled by dimmers to change output characteristics of the devices. In an example, a dimmer is used to change light output from a lighting device. In another example, a dimmer is used to change rotation speed of a fan. Further, a dimmer can includes a receiver to receive a remote control signal, such that the dimmer is remote controllable. The receiver needs to be powered on even when the dimmer is turned off.

SUMMARY

Aspects of the disclosure provide a circuit. The circuit includes a control circuit and a return path circuit. The control circuit is configured to operate in response to a first conduction angle of a dimmer coupled to the circuit. The first conduction angle is adjusted to control an output power to a first device. The dimmer has a second conduction angle that is independent of the control of the output power to the first device. The return path circuit is configured to provide a return path to enable providing power to a second device in response to the second conduction angle.

In an example, the circuit includes a startup circuit configured to enable the control circuit to start operation in response to the first conduction angle. Further, the return path circuit is configured to provide the return path to enable providing power to the second device in response to the second conduction angle when the control circuit is not in operation. In an example, the control circuit includes a return path control circuit configured to disable the return path when the control circuit is in operation. The return path control circuit is configured to disable the return path based on at least one of an input voltage to the circuit and an output voltage of the circuit.

According to an aspect of the disclosure, the return path circuit is configured to provide the return path to enable providing power to the second device in the dimmer when the control circuit is not in operation. In an example, the second device is a remote control receiver.

In an example, the return path circuit includes a transistor configured to be turned on in response to the second conduction angle when the control circuit is not in operation. In an example, the return path circuit includes a resistor and a capacitor to determine a turn on time of the transistor.

Aspects of the disclosure provide an electronic system. The electronic system includes the dimmer and the circuit coupled together.

Aspects of the disclosure provide a method. The method includes receiving an input that is regulated to have a first conduction angle and a second conduction angle. The first conduction angle is adjusted to control an output power to a first device, and the second conduction angle is independent of the control of the output power to the first device. Further the method includes turning on a return path for the input during the second conduction angle to provide power to a second device when the input provides no output power to the first device.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

Figure 1:
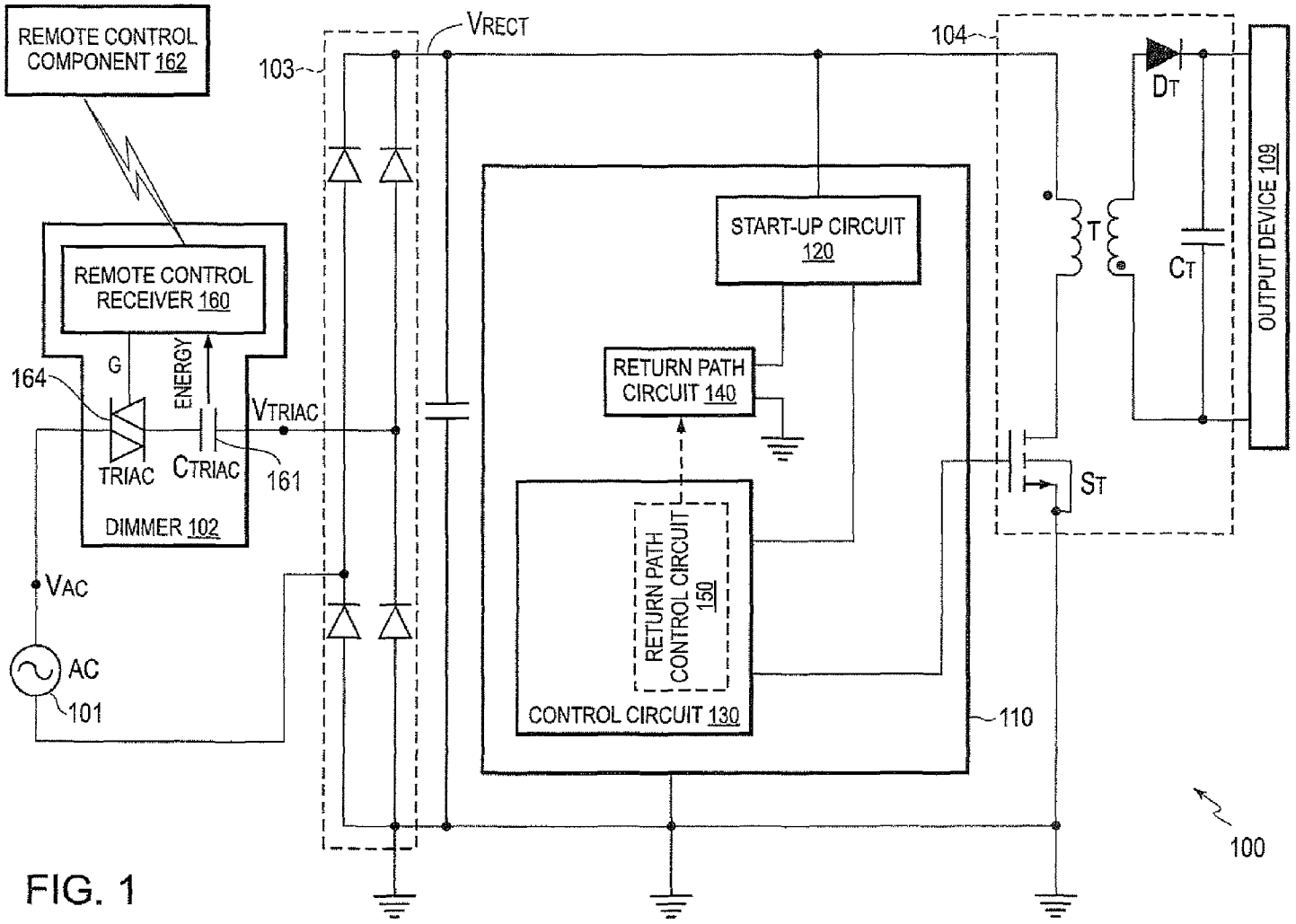
FIG. 1 shows an electronic system 100 according to an embodiment of the disclosure.

FIG. 1 shows an electronic system 100 according to an embodiment of the disclosure. The electronic system 100 includes a dimmer 102, a rectifier 103, a circuit 110, an energy transfer module 104, and an output device 109. These elements are coupled together as shown in FIG. 1.

According to an embodiment of the disclosure, the electronic system 100 is suitably coupled to an energy source 101. In the FIG. 1 example, the energy source 101 is an alternating current (AC) voltage supply to provide an AC voltage $V_{AC}$, such as 110V AC supply voltage, 220V AC supply voltage, and the like. In an example, the electronic system 100 includes a power cord that has been plugged into a wall outlet (not shown) on a power grid. In another example, the electronic system 100 is coupled to the energy source 101 via a switch (not shown). When the switch is switched on, the electronic system 100 is coupled to the energy source 101.

According to an aspect of the disclosure, the dimmer 102 is configured to control electric energy from the energy source 101 to the electronic system 100, and thus controls output power from the output device 109. For example, the dimmer 102 is turned on/off to turn on/off the output device 109, and a dimming angle of the dimmer 102 is adjusted to adjust output power from the output device 109.

Further, according to an embodiment of the disclosure, the electronic system 100 includes a component that is turned-on no matter the dimmer 102 is turned on or off when the electronic system 100 is coupled to the energy source 101. The dimmer 102 is configured to provide electric energy to the always-on component.

In an example, the dimmer 102 is a remote controllable dimmer that includes a remote control receiver 160. When the electronic system 100 is coupled to the energy source 101, the remote control receiver 160 is turned on to listen to control signals from a remote control component 162 no matter the dimmer 102 is turned on or off.

In an example, the remote control component 162 is configured to transmit a turn-on control signal. When the remote control receiver 160 receives the turn-on control signal, the dimmer 102 is turned on to start providing electric energy to other devices, such as to the output device 109 in the electronic system 100. Further, in an example, the remote control component 162 is configured to transmit a power adjustment signal. When the remote control receiver 160 receives the power adjustment signal, the dimmer 102 adjusts the electric energy provided to the output device 109 according to the received power adjustment signal. Then, in an example, the remote control component 162 is configured to transmit a turn-off control signal. When the remote control receiver 160 receives the turn-off control signal, the dimmer 102 is turned off to stop providing electric energy to the other devices in the electronic system 100, and thus turns off the output device 109 in an example.

It is noted that even when the dimmer 102 is turned off to stop providing electric energy to the output device 109, the remote control receiver 160 in the dimmer 102 needs to continue operation to listen to the control signals from the remote control component 162. In an embodiment, the dimmer 102 provides the necessary energy to support the remote control receiver 160 even when the dimmer 102 is turned off to stop providing electric energy to the output device 109.

According to an aspect of the disclosure, the dimmer 102 is a phase angle based dimmer. In an example, the AC voltage supply has a sine wave shape, and the dimmer 102 includes a forward-type triode for alternating current (TRIAC) 164 having an adjustable dimming angle $\alpha$ within $[0, \pi]$. Every time the AC voltage $V_{AC}$ crosses zero, the forward-type TRIAC 164 stops firing charges for a dimming angle $\alpha$. The dimming angle $\alpha$ is adjusted to turn on/off the dimmer 102 and adjust the output power of the output device 109. For example, when the dimming angle $\alpha$ is equal to $\pi$, the dimmer 102 is turned off; when the dimming angle $\alpha$ is reduced from $\pi$, the dimmer 102 is turned on; when the dimming angle $\alpha$ is further reduced, the output power of the output device 109 is increased; and when the dimming angle $\alpha$ is zero, the output power of the output device 109 is maximized.

Further, according to an aspect of the disclosure, the forward-type TRIAC 164 additionally fires charges for a time duration that is independent of the dimming angle $\alpha$ to provide electric energy to the always-on component in the electronic system 100, such as the remote control receiver 160.

Thus, in an example, the forward-type TRIAC 164 has first conduction angles that depend on the dimming angle $\alpha$, such as $[\alpha, \pi]$ and $[\pi+\alpha, 2\pi]$, 270, and has a second conduction angle that is independent of the dimming angle $\alpha$, such as a relatively small time during at the beginning of each AC cycle. When a phase of the AC voltage $V_{AC}$ is within a conduction angle, the forward-type TRIAC 164 fires charges, and a TRIAC voltage $V_{TRIAC}$ follows the AC voltage $V_{AC}$; and when the phase of the AC voltage $V_{AC}$ is out of any conduction angle, the TRIAC voltage $V_{TRIAC}$ output from the forward-type TRIAC 164 is zero.

According to an embodiment of the disclosure, the dimmer 102 includes an energy storing element 161 to store electric energy for the remote control receiver 160. In the FIG. 1 example, the energy storing element 161 is a capacitor $C_{TRIAC}$. The capacitor $C_{TRIAC}$ is configured to store electric energy when the forward-type TRIAC 164 fires charges, and provide the stored electric energy to the remote control receiver 160. In an embodiment, even when the dimmer 102 is turned off that the dimming angle $\alpha$ is $\pi$, the forward TRIAC 164 fires charges during the second conduction angle that is independent of the dimming angle $\alpha$, thus the capacitor $C_{TRIAC}$ stores and provides electric energy to support the remote control receiver 160 that is always turned on.

According to an aspect of the disclosure, a low impedance return path is required to enable the dimmer 102 to store electric energy in the energy storing element 161. In an example, the capacitor $C_{TRIAC}$ has a relatively large capacitance, such as in the order of 10 μF, and thus the impedance of the return path needs to be much lower than the impedance of the capacitor $C_{TRIAC}$ to enable the capacitor $C_{TRIAC}$ to store the electric energy.

According to an aspect of the disclosure, even when the dimmer 102 is turned off to stop providing output power to the output device 109, the electronic system 100 provides a low impedance return path to enable the energy storing element 161 in the dimmer 102 to store electric energy.

According to an embodiment of the disclosure, the dimmer 102 is integrated with other components in the electronic system 100. In another embodiment, the dimmer 102 is a separate component, and is suitably coupled with the other components of the electronic system 100. It is noted that the dimmer 102 can include other suitable components, such as a processor (not shown), and the like.

The rectifier 103 rectifies the received AC voltage to a fixed polarity, such as to be positive. In the FIG. 1 example, the rectifier 103 is a bridge rectifier 103. The bridge rectifier 103 receives the AC voltage, generates a rectified voltage $V_{RECT}$, and provides the rectified voltage $V_{RECT}$ to other components of the electronic system 100, such as the circuit 110 and the like, to provide electric power to the electronic system 100. An example waveform of the rectified voltage $V_{RECT}$ is shown in FIG. 2.

Figure 2:
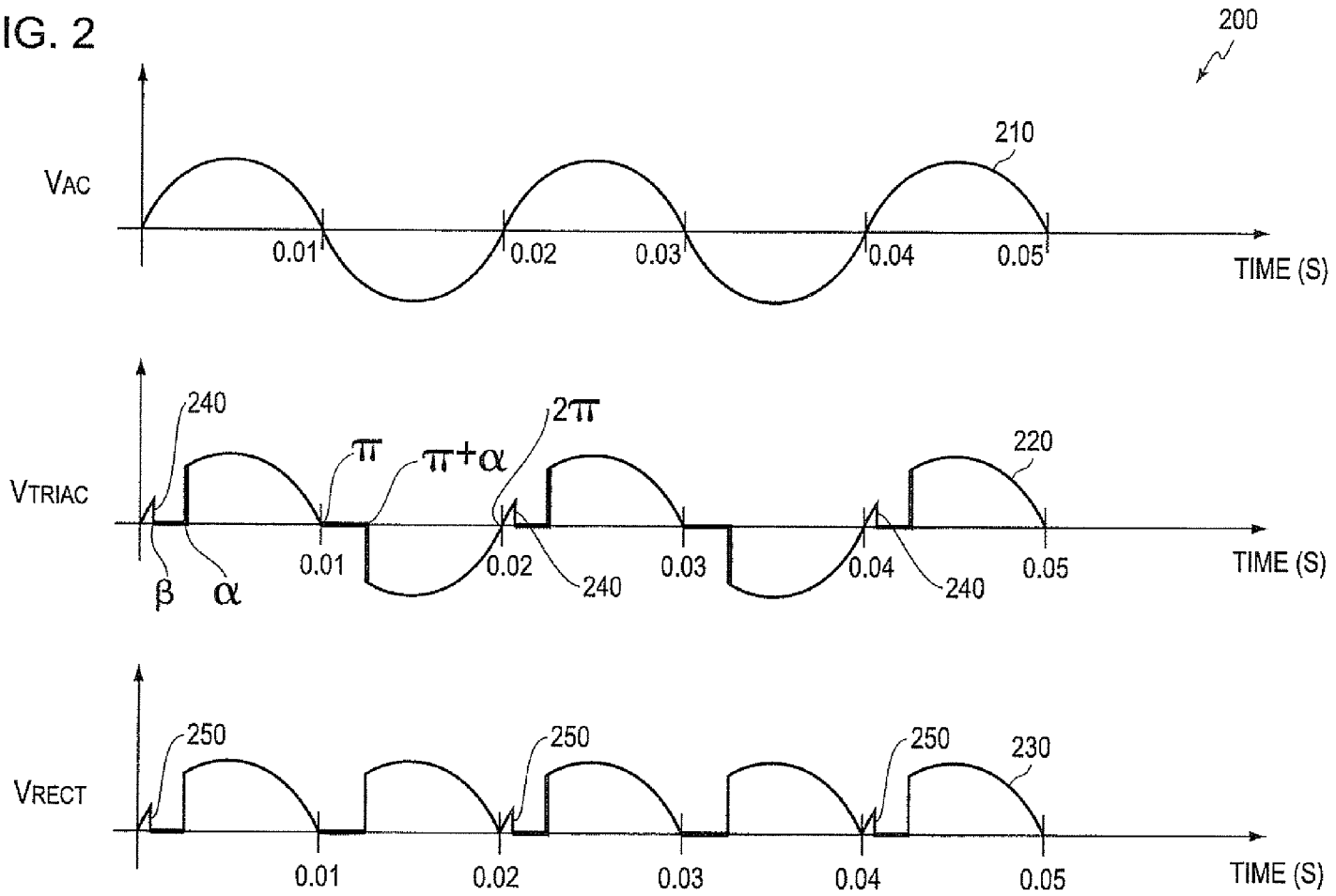
FIG. 2 shows a plot 200 of waveforms according to an embodiment of the disclosure.

FIG. 2 shows a plot 200 of waveforms for the electronic system 100 according to an embodiment of the disclosure. The plot 200 includes a first waveform 210 for the AC supply voltage $V_{AC}$, a second waveform 220 for the TRIAC voltage $V_{TRIAC}$, and a third waveform 230 for the rectified voltage $V_{RECT}$.

As can be seen in FIG. 2, the AC voltage $V_{AC}$ has a sinusoidal waveform, and has a frequency of 50 Hz. The TRIAC voltage $V_{TRIAC}$ is zero when the phase of the AC voltage $V_{AC}$ is out of any conduction angle and follows the shape of the AC voltage $V_{AC}$ when the phase of the AC voltage $V_{AC}$ is in a conduction angle. The rectified voltage $V_{RECT}$ is rectified from the TRIAC voltage $V_{TRIAC}$ to have positive polarity.

Specifically, in the FIG. 2 example, the dimmer 102 has a dimming angle $\alpha$. Thus, the TRIAC voltage $V_{TRIAC}$ has first conduction angles, such as $[\alpha, \pi]$ and $[\pi+\alpha, 2\pi]$, that depend on the dimming angle $\alpha$ and has a second conduction angle, such as $[0, \beta]$, that is independent of the dimming angel $\alpha$.

In each cycle $[0, 2\pi]$, when the phase of the AC voltage $V_{AC}$ is within the second conduction angle $[0, \beta]$, the AC voltage $V_{AC}$ is positive, the TRIAC voltage $V_{TRIAC}$ follows the AC voltage $V_{AC}$, as shown by 240, and the rectified voltage $V_{RECT}$ is about the same as the TRIAC voltage $V_{TRIAC}$, as shown by 250; when the phase of the AC voltage $V_{AC}$ is within $[\beta, \alpha]$ or $[\pi, \pi+\alpha]$, the TRIAC voltage $V_{TRIAC}$ output from the forward-type TRIAC dimmer 102 is about zero, and the rectified voltage $V_{RECT}$ is about zero; when the phase of the AC voltage $V_{AC}$ is within $[\alpha, \pi]$, the AC voltage $V_{AC}$ is positive, the TRIAC voltage $V_{TRIAC}$ follows the AC voltage $V_{AC}$, and the rectified voltage $V_{RECT}$ is about the same as the TRIAC voltage $V_{TRIAC}$; and when the phase of the AC voltage $V_{AC}$ is within [π+α, 2π], the AC voltage $V_{AC}$ is negative, the TRIAC voltage $V_{TRIAC}$ follows the AC voltage $V_{AC}$, and the rectified voltage $V_{RECT}$ is about negative of the TRIAC voltage $V_{TRIAC}$.

According to an embodiment of the disclosure, the second conduction angle is relatively small and independent of the dimming angle α. At the beginning of each cycle, the rectified voltage $V_{RECT}$ increases from zero to a peak voltage, and then drops to zero in response to the second conduction angle, as shown by 250.

The rectified voltage $V_{RECT}$ is provided to following circuits, such as the circuit 110, the energy transfer module 104, and the output device 109, and the like in the electronic system 100. In an embodiment, the circuit 110 is implemented on a single integrated circuit (IC) chip. In another embodiment, the circuit 110 is implemented on multiple IC chips. The circuit 110 is suitably coupled with the other components in the electronic system 100. For example, the circuit 110 provides control signals to the energy transfer module 104. The energy transfer module 104 transfers the provided electric energy by the rectified voltage $V_{RECT}$ to the output device 109.

In an example, the energy transfer module 104 includes a transformer T and a switch $S_T$. The energy transfer module 104 also includes other suitable components, such as a diode $D_T$, a capacitor $C_T$, and the like. The transformer T includes a primary winding coupled with the switch $S_T$ and a secondary winding coupled to the output device 109. In an embodiment, the circuit 110 provides control signals to control the operations of the switch $S_T$ to transfer the energy from the primary winding to the secondary winding. In an example, the circuit 110 provides pulses having a relatively high frequency, such as in the order of 100 KHz, to control the switch $S_T$. The relatively high frequency pulses enable power factor correction (PFC) for the AC supply.

The output device 109 can be any suitable device, such as a light bulb, a plurality of light emitting diodes (LEDs), a fan and the like.

According to an embodiment of the disclosure, the circuit 110 includes a return path circuit 140. The return path circuit 140 is configured to provide a low impedance return path when the dimmer 102 is turned off to stop providing electric energy to the output device 109.

According to an embodiment of the disclosure, when the dimmer 102 is turned on to provide electric energy to the output device 109, the electronic system 100 has a low impedance return path. For example, when the dimmer 102 is turned on, the circuit 110 is powered up, and provides relatively high frequency pulses to repetitively switch on/off the switch $S_T$. Thus, the transformer T and the switch $S_T$ form a return path when the dimmer 102 is turned on.

When the dimmer 102 is turned off to stop providing energy to the output device 109 (e.g., the dimming angle α being π), the circuit 110 is powered down and unable to provide the pulses to the switch $S_T$, and the switch $S_T$ is in the off state, and breaks the return path formed by the transformer T and the switch $S_T$. The return path circuit 140 is configured to provide a low impedance return path to the dimmer 102 when the dimmer 102 is turned off.

In an embodiment, the circuit 110 includes a startup circuit 120 and a control circuit 130. The startup circuit 120 is configured to startup the circuit 110 when the dimmer 102 is switched from being turned off to being turned on. In an embodiment, after startup, the control circuit 130 is enabled to provide pulses to the switch $S_T$, and thus the transformer T and the switch $S_T$ form a low impedance return path.

According to an example of the disclosure, the return path circuit 140 is coupled to the startup circuit 120 to operate based on the operation of the startup circuit 120. For example, the return path circuit 140 turns on a return path in the circuit 110 before the startup circuit 120 starts up the circuit 110 and the return path circuit 140 turns off the return path in the circuit 110 to reduce current leakage after the startup circuit 120 starts up the circuit 110.

In an example, the control circuit 130 includes a return path control circuit 150 coupled to the return path circuit 140. In an example, before startup, the return path circuit 140 turns on the return path when control signals from the return path control circuit are not available. After startup, the return path control circuit 150 generates control signals to turn off the return path formed by the return path circuit 140.

It is noted that the control circuit 130 includes various control circuits, such as a control circuit for controlling a depletion mode transistor in the start-up circuit 120, a control circuit for controlling the switch $S_T$, the return path control circuit 150 for controlling the return path circuit 140, and the like. Different control circuits can be enabled to start operation in response an output voltage from the start-up circuit 120 at different voltage levels. In an example, the control circuit for controlling the switch $S_T$ is configured to operate when the output voltage from the start-up circuit 120 is above a relatively high voltage level, such as 10V and the like; and the control circuit for controlling the depletion mode transistor in the start-up circuit 120 and the return path control circuit 150 are configured to operate when the output voltage from the start-up circuit 120 is above a relatively low voltage level, such as 4V and the like.

Figure 3:
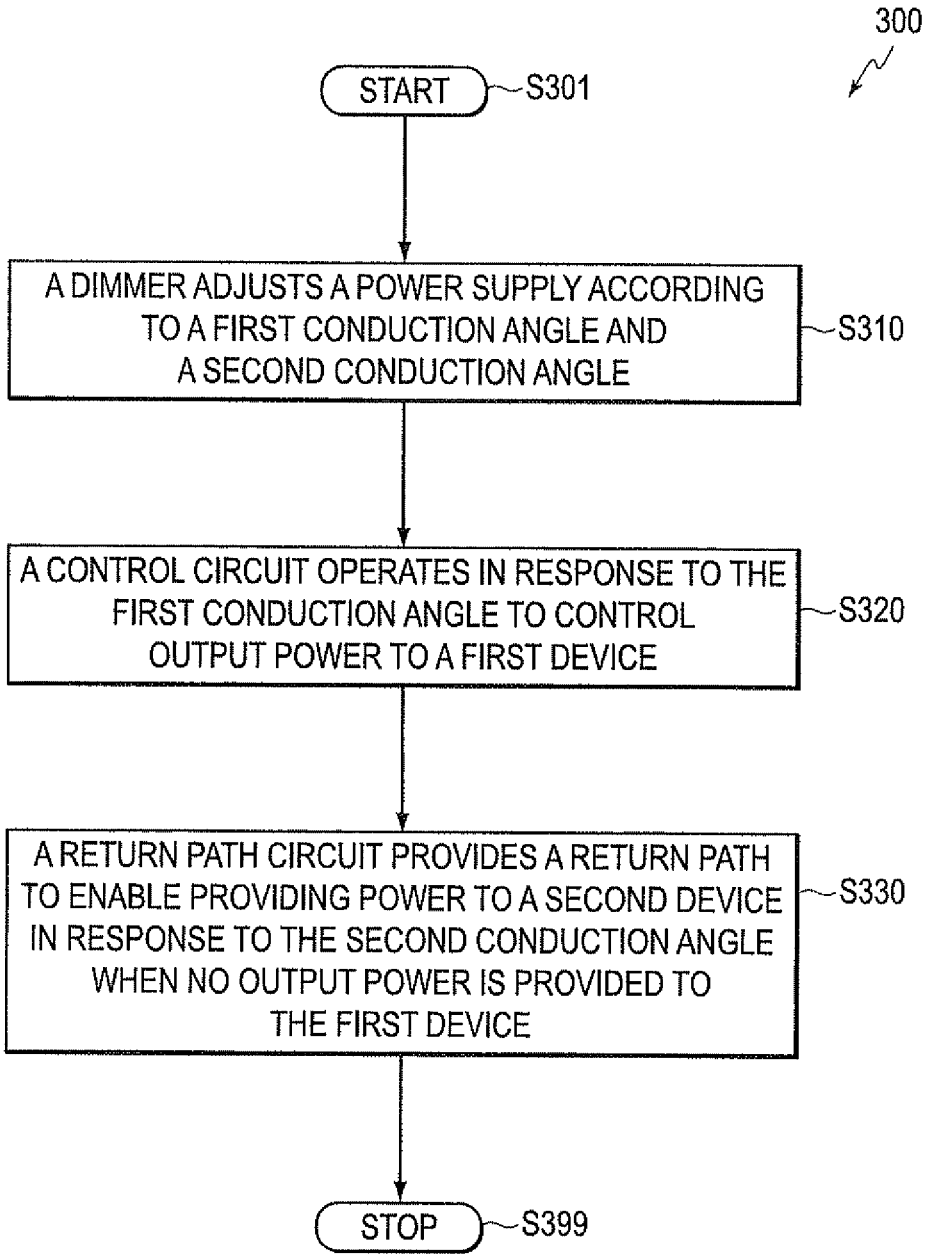
FIG. 3 shows a flowchart outlining a process 300 according to an embodiment of the disclosure.

FIG. 3 shows a flowchart outlining a process 300 performed by the electronic system 100 according to an embodiment of the disclosure. The process starts at S301 and proceeds to S310.

At S310, the dimmer 102 receives the AC power supply, and adjusts power supply to following circuits according to conduction angles. Specifically, in each AC cycle, when the phase of the AC power supply is within a conduction angle, the dimmer 102 fires charges, and the output voltage from the dimmer 102 follows the voltage of the AC power supply; and when the phase of the AC power supply is not within any conduction angle, the dimmer 102 does not fire charges, and the output voltage from the dimmer 102 is zero. In an example, when the dimmer 102 is turned on, in each AC cycle, there exists at least a first conduction angle and a second conduction angle. The first conduction angle is related to the dimming angle α of the dimmer 102 that determines output power to the output device 109. The second conduction angle is independent of the dimming angle α. When the dimmer 102 is turned off, the first conduction angle does not exist, and the second conduction angle still exists at the beginning of each AC cycle. The second conduction angle is intended to provide electric energy to certain circuits, such as the remote control receiver 160, that need to stay in operation even when the dimmer 102 is turned off.

At S320, the control circuit 130 operates in response to the first conduction angle to control output power to a first device, such as the output device 109. For example, when the first conduction angle exists in each AC cycle, the start-up circuit 120 starts up the circuit 110 and enables the operation of the control circuit 130. The control circuit 130 then provides control signals to control the energy transfer module 104 to transfer the provided electric energy by the rectified voltage $V_{RECT}$ to the output device 109.

At S330, the return path circuit 140 provides a return path to enable providing electric energy to a second device, such as the remote control receiver 160, in response to the second conduction angles when the dimmer 102 is turned off. For example, when the dimmer 102 is turned off, the dimming angle is π, the first conduction angle does not exist in an AC cycle. The control circuit 130 is not in operation, and no output power is provided to the output device 109. Then, the return path circuit 140 in the circuit 110 provides a return path to enable the capacitor $C_{TRIAC}$ to store electric energy in response to the second conduction angles. The stored electric energy supports the operation of the remote control receiver 160. Then, the process proceeds to S399 and terminates.

Figure 4:
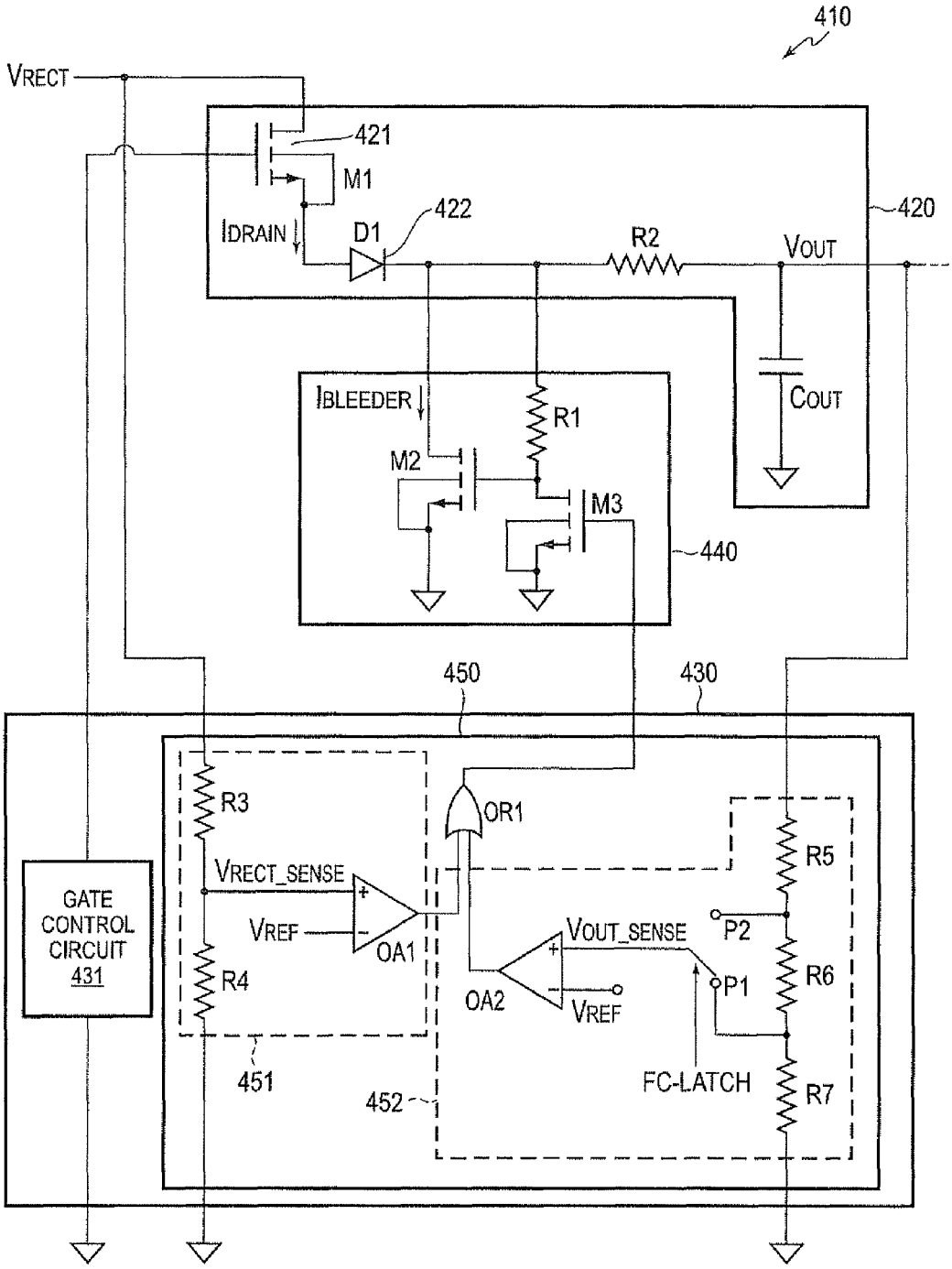
FIG. 4 shows a block diagram of a circuit example 410 according to an embodiment of the disclosure.

FIG. 4 shows a block diagram of a circuit example 410 according to an embodiment of the disclosure. The circuit 410 can be used in the electronic system 100 as the circuit 110.

In the FIG. 4 example, the circuit 410 includes a start-up circuit 420, a return path circuit 440, and a control circuit 430. According to an embodiment of the disclosure, the start-up circuit 420 is configured to start up at least a portion of the circuit 410, such as the control circuit 430, when the dimmer 102 is turned on to provide output power to the output device 109. The return path circuit 440 is configured to provide a return path for the dimmer 102 when the dimmer 102 is turned off, in an example. The control circuit 430 is configured to provide various control signals to internal circuits of the circuit 410 and external circuits to the circuit 410 when the dimmer 102 is turned on.

In the FIG. 4 example, the start-up circuit 420 includes a transistor M1 coupled with a diode D1 and a resistor R2 to charge a capacitor $C_{OUT}$. In an embodiment, the transistor M1 is a depletion mode transistor, such as an N-type depletion mode metal-oxide-semiconductor-field-effect-transistor (MOSFET) that has a negative threshold voltage, such as (−3V), configured to be conductive when control voltages are not available. For example, during an initial power receiving stage (e.g., at the time when the dimmer 102 is switched from being turned off to being turned on), because the gate-to-source and the gate-to-drain voltages of the N-type depletion mode MOSFET M1 are about zero and are larger than the negative threshold voltage, thus an N-type conductive channel exists between the source and drain of the N-type depletion mode MOSFET M1 even without a gate control voltage. The N-type depletion mode MOSFET M1 allows an inrush current to enter the circuit 410 and charge the capacitor $C_{OUT}$. Further, when the circuit 410 enters the normal operation mode, the control circuit 430 provides control signals to turn on/off the N-type depletion mode MOSFET M1 to charge the capacitor $C_{OUT}$ and maintain the voltage on the capacitor $C_{OUT}$.

In the FIG. 4 example, the return path circuit 440 includes two transistors M2 and M3 and a resistor R1. The resistor R1 and M3 are coupled together to receive a control signal from the control circuit 430 and to control a gate voltage of the transistor M2. In an example, the transistor M2 and the transistor M3 are N-type enhance mode MOSFETs that have positive threshold voltage.

During operation, in an example, when the dimmer 102 is turned off, the rectified voltage $V_{RECT}$ is unable to charge the capacitor $C_{OUT}$ to an output voltage level to enable the operation of the control circuit 430, and thus the control circuit 430 does not provide a control signal to the transistor M3. Thus, the transistor M3 is turned off. Then, the output voltage $V_{OUT}$ controls the gate voltage of the transistor M2 via the resistor R1. For example, when the output voltage $V_{OUT}$ is larger than the threshold voltage of the transistor M2, such as larger than 3V, the transistor M2 is turned on. In an example, the transistor M2 is suitably designed to have a low impedance when it is turned on. When the transistor M2 is turned on, the transistor M2 forms a low impedance return path to ground, and conducts a bleeding current $I_{BLEEDER}$ to the ground. When the output voltage $V_{OUT}$ is smaller than the threshold voltage of the transistor M2, the transistor M2 is turned off.

In the FIG. 4 example, the control circuit 430 includes a gate control circuit 431 and a return path control circuit 450. In an embodiment, the gate control circuit 431 is configured to control the gate terminal of the transistor M1 when the control circuit 430 is in operation. In an example, when the dimmer 102 is turned on, the start-up circuit 420 charges the capacitor $C_{OUT}$ to above certain voltage level enable the operation of the control circuit 430. It is noted that different portions of the control circuit 430 can be enabled to operate at different voltage levels. In an example, when the output voltage $V_{OUT}$ on the capacitor $C_{OUT}$ is above 4V, the gate control circuit 431 is operative. Then, the gate control circuit 431 detects the output voltage $V_{OUT}$ on the capacitor $C_{OUT}$, and turns on/off the transistor M1 based on the detected output voltage $V_{OUT}$ in order to maintain the output $V_{OUT}$ on the capacitor $C_{OUT}$. For example, when the gate control circuit 431 detects that the output voltage $V_{OUT}$ on the capacitor $C_{OUT}$ drops to a lower limit of a desired range, the gate control circuit 431 turns on the transistor M1 to charge the capacitor $C_{OUT}$; when the gate control circuit 431 detects that the output voltage $V_{OUT}$ on the capacitor $C_{OUT}$ increases to an upper limit of the desired range, the gate control circuit 431 turns off the transistor M1 to stop charging the capacitor $C_{OUT}$. It is noted that when the dimmer 102 is turned off, the output voltage $V_{OUT}$ on the capacitor $C_{OUT}$ is lower than the voltage level, such as 4V, that can enable the operation of the gate control circuit 431, and the gate control circuit 431 is unable to provide the gate control signal to the transistor M1.

In another example, the control circuit 430 includes a switch control portion (not shown) configured to provide pulses to, for example, the switch $S_T$ in FIG. 1. The switch control portion is configured to provide the pulses when the output voltage $V_{OUT}$ on the capacitor $C_{OUT}$ is above 10V, for example. When the dimmer 102 is turned off; the output voltage $V_{OUT}$ on the capacitor $C_{OUT}$ is lower than the voltage level, such as 10V, to enable the switch control portion of the control circuit 430, then the control circuit 430 does not provide pulses to the switch $S_T$.

The return path control circuit 450 is configured to control the return path circuit 440 when the control circuit 430 is enabled to operate. In an example, when the dimmer 102 is turned on, the start-up circuit 420 charges the capacitor $C_{OUT}$ to above certain voltage level, such as above 10V to enable the operation of the control circuit 430. In an embodiment, the control circuit 430 provides control signals to external circuits to form a return path that is out of the circuit 410. Further, the return path control circuit 450 controls the return path circuit 440 to turn off the return path within the circuit 410 to reduce the power leakage in an example.

According to an aspect of the disclosure, the return path control circuit 450 is configured to sense the rectified voltage $V_{RECT}$ and the output voltage $V_{OUT}$, and controls the return path circuit 440 based on the rectified voltage $V_{RECT}$ and the output voltage $V_{OUT}$.

In the FIG. 4 example, the return path control circuit 450 includes a rectified voltage sensing circuit 451. The rectified voltage sensing circuit 451 includes resistors R3 and R4, and a first comparator OA1. The resistors R3 and R4 form a voltage divider to sense the rectified voltage $V_{RECT}$, and to generate a sensed rectified voltage $V_{RECT_SENSE}$. The first comparator OA1 is configured to compare the sensed rectified voltage $V_{RECT_SENSE}$ with a reference voltage $V_{REF}$. It is noted that, in an example, the reference voltage $V_{REF}$ is generated by the control circuit 430.

Further, the return path control circuit 450 includes an output voltage sensing circuit 452. The output voltage sensing circuit 452 includes resistors R5, R6 and R7 and a second comparator OA2. The resistors R5, R6 and R7 form a voltage divider with a switchable ratio to sense the output voltage $V_{OUT}$, and to generate a sensed output voltage $V_{OUT_SENSE}$. The second comparator OA2 is configured to compare the sensed output voltage $V_{OUT_SENSE}$ reference voltage $V_{REF}$.

In the FIG. 4 example, the output of the first comparator OA1 and output of the second comparator OA2 are combined to control the return path circuit 440.

According to an aspect of the disclosure, the return path control circuit 450 is configured to control the return path circuit 440 to turn off the return path when the rectified voltage $V_{RECT}$ is larger than the peak voltage in the second conduction angle. In an example, the second conduction angle is generally a short period at the beginning of an AC cycle that the AC voltage increases from zero to the peak voltage and then drops to zero (e.g., 250 in FIG. 2). A resistance ratio of the resistors R3 and R4 are suitably determined that when the rectified voltage $V_{RECT}$ is larger than the peak voltage of the second conduction angle, the sensed rectified voltage $V_{RECT_SENSE}$ is larger than the reference voltage $V_{REF}$. Thus, when the rectified voltage $V_{RECT}$ is larger than the peak voltage, the output of the first comparator OA1 is "1", and the transistor M3 in the return path circuit 440 is turned on to pull down the gate voltage of the transistor M2, and thus the transistor M2 is turned off and the return path within the circuit 410 is shut off.

It is noted that the rectified voltage sensing circuit 451 is not sensitive to low conduction angles. Specifically, when the dimmer 102 is turned on to provide relatively small output power to the output device 109, the rectified voltage $V_{RECT}$ during the first conduction angles can be lower than the peak voltage of the second conduction angle. Thus, the sensed rectified voltage $V_{RECT_SENSE}$ can be lower than the reference voltage $V_{REF}$, and the output of the first comparator OA1 is "0".

In an embodiment, even when the dimming angle is large and the first conduction angles are low, the rectified voltage $V_{RECT}$ is able to charge the capacitor $C_{OUT}$ to have a relatively large output voltage $V_{OUT}$. Then, the output sensing circuit 452 controls the return path circuit 440 to turn off the return path in the circuit 410. Specifically, when the sensed output voltage $V_{OUT_SENSE}$ is larger than the reference voltage, the output of the second comparator OA2 is "1", and the transistor M3 in the return path circuit 440 is turned on to pull off the gate voltage of the transistor M2 in order to shut off the return path in the circuit 410.

According to another aspect of the disclosure, the output sensing circuit 452 is configured to use two thresholds for the output voltage $V_{OUT}$ to control the return path in the return path circuit 440. In an example, the voltage divider is configured to have a relatively large ratio to sense the output voltage $V_{OUT}$ when the output voltage $V_{OUT}$ is below a voltage level that enables the operation of the control circuit 430. For example, at default, the sensed output voltage $V_{OUT_SENSE}$ is at P2. Thus, the output sensing circuit 452 uses a relatively small threshold for the output voltage $V_{OUT}$. Further, the voltage divider is configured to have a relatively small ratio to sense the output voltage $V_{OUT}$ when the output voltage $V_{OUT}$ is above the voltage level that enables the operation of the control circuit 430. For example, the sensed output voltage $V_{OUT_SENSE}$ is at P1 when the control circuit 430 is enabled. In an example, the sensed output voltage $V_{OUT_SENSE}$ is switched based on a FC-LATCH signal generated by the control circuit 430. In an example, when the capacitor $C_{OUT}$ is charged that the output voltage $V_{OUT}$ is above a certain level, such as 15V, for the first time, the FC-LATCH signal is latched. The FC-LATCH signal is used to change the thresholds to control the return path in the return path circuit 440.

In an example, when the dimmer 102 is turned off, the output sensing circuit 452 uses the relatively small threshold. In addition, the output voltage $V_{OUT}$ is below the voltage level to enable the operation of the control circuit 430, and thus the control circuit 430 is unable to turn on the transistor M3. Then, the transistor M2 is turned on to form the return path in the circuit 410. In an example, the return path enables providing electric energy to the always-on component, such as the remote control receiver 160, in the dimmer 102.

Further, in the example, when the dimmer 102 is switched from being turned off to being turned on, the rectified voltage $V_{RECT}$ charges the capacitor $C_{OUT}$. When the output voltage $V_{OUT}$ on the $C_{OUT}$ is above the level to enable the operation of the control circuit 430, the control circuit 430 starts operating, The control circuit 430 generates the reference voltage $V_{REF}$. When the output voltage $V_{OUT}$ is above 15V for the first time, the FC-LATCH signal is latched and is used to switch the sensed output voltage $V_{OUT_SENSE}$ to P1, and the output sensing circuit 452 uses a relatively large threshold for the output voltage $V_{OUT}$. Then, when the output voltage $V_{OUT}$ is larger than the relatively large threshold, the second comparator OA2 outputs "1" to turn on the transistor M3 to pull down the gate voltage of the transistor M2 and turn off the transistor M2.

When the dimmer 102 is switched from being turned on to being turned off, the rectified voltage $V_{RECT}$ stays low, and the output voltage $V_{OUT}$ starts dropping. Because the threshold voltage is relatively high, the output voltage $V_{OUT}$ drops below the threshold voltage in a relatively short time, and the output of the second comparator OA2 switches from "1" to "0" in a relatively short time. The output of the first comparator OA1 is also "0" due to the low rectified $V_{RECT}$. Then, the transistor M3 is turned off in a relatively short time, and the transistor M2 is turned on in a relatively short time.

Figure 5:
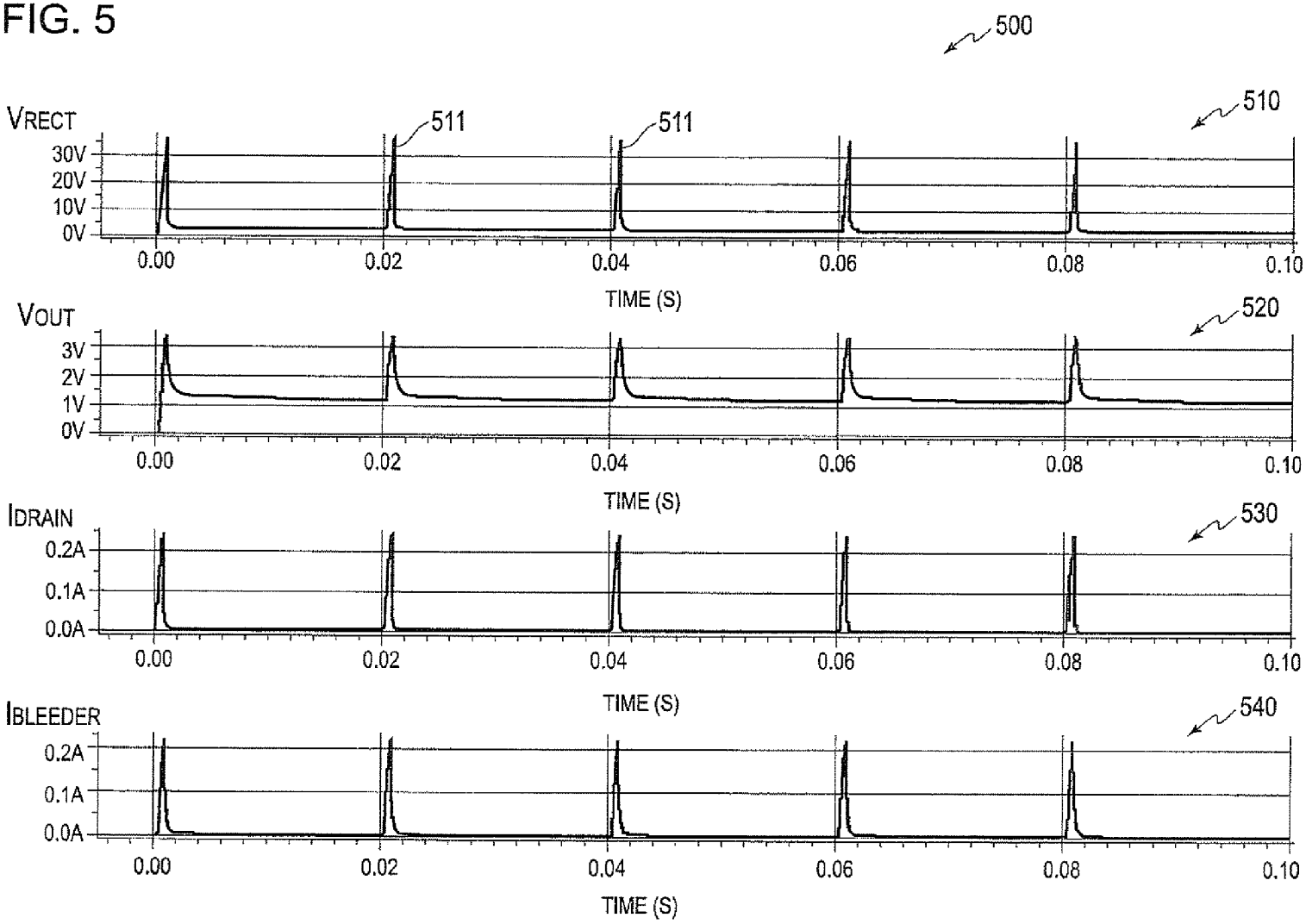
FIG. 5 shows a plot 500 of waveforms for the circuit 410 according to an embodiment of the disclosure.

FIG. 5 shows a plot 500 of waveforms for the circuit 410 when the dimmer 102 is turned off according to an embodiment of the disclosure. The plot 500 includes a first waveform 510 for the rectified voltage $V_{RECT}$, a second waveform 520 for the output voltage $V_{OUT}$, a third waveform 530 for the drain current $I_{DRAIN}$ of the transistor M1, and a fourth waveform 540 for the bleeding current $I_{BLEEDER}$ of the transistor M2.

According to an embodiment, at beginning of each AC cycle, the dimmer 102 has a conduction angle that is independent of the state of the dimmer 102. The conduction angle allows the dimmer 102 to fire charges to provide electric energy to the always-on component, such as the remote control receiver 160, even when the dimmer 102 has been turned off.

During the conduction angle at the beginning of each AC cycle, the rectified voltage $V_{RECT}$ follows the AC supply to increase from zero to the peak voltage and then drop to zero, as shown by 511 in FIG. 5.

Because the rectified $V_{RECT}$ is non-zero within the conduction angle, the startup circuit 420 charges the capacitor $C_{OUT}$ and increases the output voltage $V_{OUT}$ during the conduction angle. Because when the output voltage $V_{OUT}$ is below a level to enable the operation of the control circuit 430, the control circuit 430 is not able to provide the control signal to the transistor M3. Thus, the transistor M3 is turned off. When the output voltage $V_{OUT}$ is above the threshold voltage of the transistor M2, such as about 3V, the transistor M2 is turned on to form the return path to ground. The return path conducts the bleeding current $I_{BLEEDER}$ that is about same as the drain current $I_{DRAIN}$. The return path enables the dimmer 102 to provide electric energy to the always-on component. The return path also discharges the buildup on the capacitor $C_{OUT}$, and thus reduces the output voltage $V_{OUT}$. When the output voltage $V_{OUT}$ drops below the threshold of the transistor M2, the transistor M2 is turned off, and the bleeding current $I_{BLEEDER}$ drops to about zero.

Figure 6:
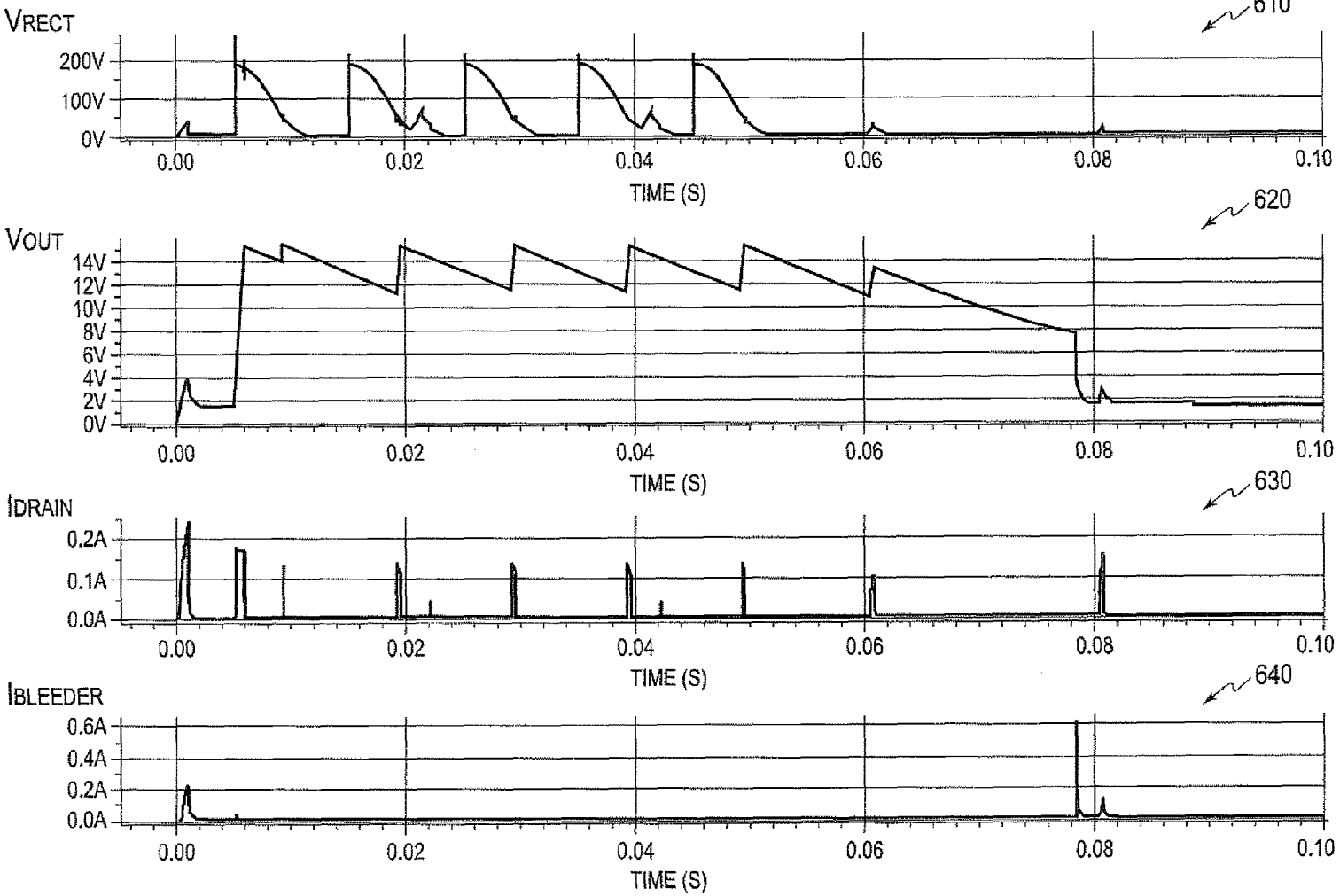
FIG. 6 shows a plot 600 of waveforms for the circuit 410 according to an embodiment of the disclosure.

FIG. 6 shows a plot 600 of waveforms for the circuit 410 when the dimmer 102 is switched from being turned on to being turned off according to an embodiment of the disclosure. The plot 600 includes a first waveform 610 for the rectified voltage $V_{RECT}$, a second waveform 620 for the output voltage $V_{OUT}$, a third waveform 630 for the drain current $I_{DRAIN}$ of the transistor M1, and a fourth waveform 640 for the bleeding current $I_{BLEEDER}$ of the transistor M2.

In the FIG. 6 example, at about 0.05 seconds, the dimmer 102 is switched from being turned on to being turned off. According to an embodiment, when the dimmer 102 is turned on, the dimmer 102 regulates the output according to a first conduction angle that depends on the dimming angle of the dimmer 102, and a second conduction angle at the beginning of each AC cycle that is independent of the dimming angle. When the dimmer 102 is turned off, the first conduction angle does not exist, and the second conduction angle still exists at the beginning of each AC cycle.

As can be seen from the first waveform 610, before the dimmer 102 is switched off, during the first conduction angle and the second conduction angle, the rectified voltage $V_{RECT}$ follows the absolute value of the AC supply voltage.

Before the dimmer 102 is switched off, the control circuit 430 is in operation. As can be seen from the second waveform 620 and the second waveform 630, the gate control circuit 431 controls the transistor M1 to turn on/off to let the rectified voltage $V_{RECT}$ charge the capacitor $C_{OUT}$, and maintain the output voltage $V_{OUT}$ in a desired range, such as within [11V, 15V] range.

Before the dimmer 102 is switched off, the return path control circuit 450 detects that the dimmer 102 is on, and control the return path circuit 440 to turn off the return path in the circuit 410. For example, the rectified voltage sensing circuit 451 detects the voltage level of the rectified voltage $V_{RECT}$ and the output voltage sensing circuit 452 detects the output voltage $V_{OUT}$ to determine the dimmer 102 is still on. As can be seen from the fourth waveform 640, no bleeding current passes the transistor M2 before the dimmer 102 is switched off.

When the dimmer 102 is switched off, the first conduction angle does not exists, the rectified voltage $V_{RECT}$ is only non-zero during the second conduction angle (at the beginning of each AC cycle). The rectified voltage $V_{RECT}$ can no longer charge the capacitor $C_{OUT}$ to maintain the output voltage $V_{OUT}$, and thus the output voltage $V_{OUT}$ drops to relatively low level, such as 2V. The control circuit 430 is no longer in operation, and cannot provide the control signal to turn on the transistor M3. Further, during the second conduction angle, the output voltage $V_{OUT}$ increases due to the non-zero rectified voltage $V_{RECT}$. When the output voltage $V_{OUT}$ is larger than the threshold voltage of the transistor M2, the transistor M2 is turned on to form the return path.

Figure 7:
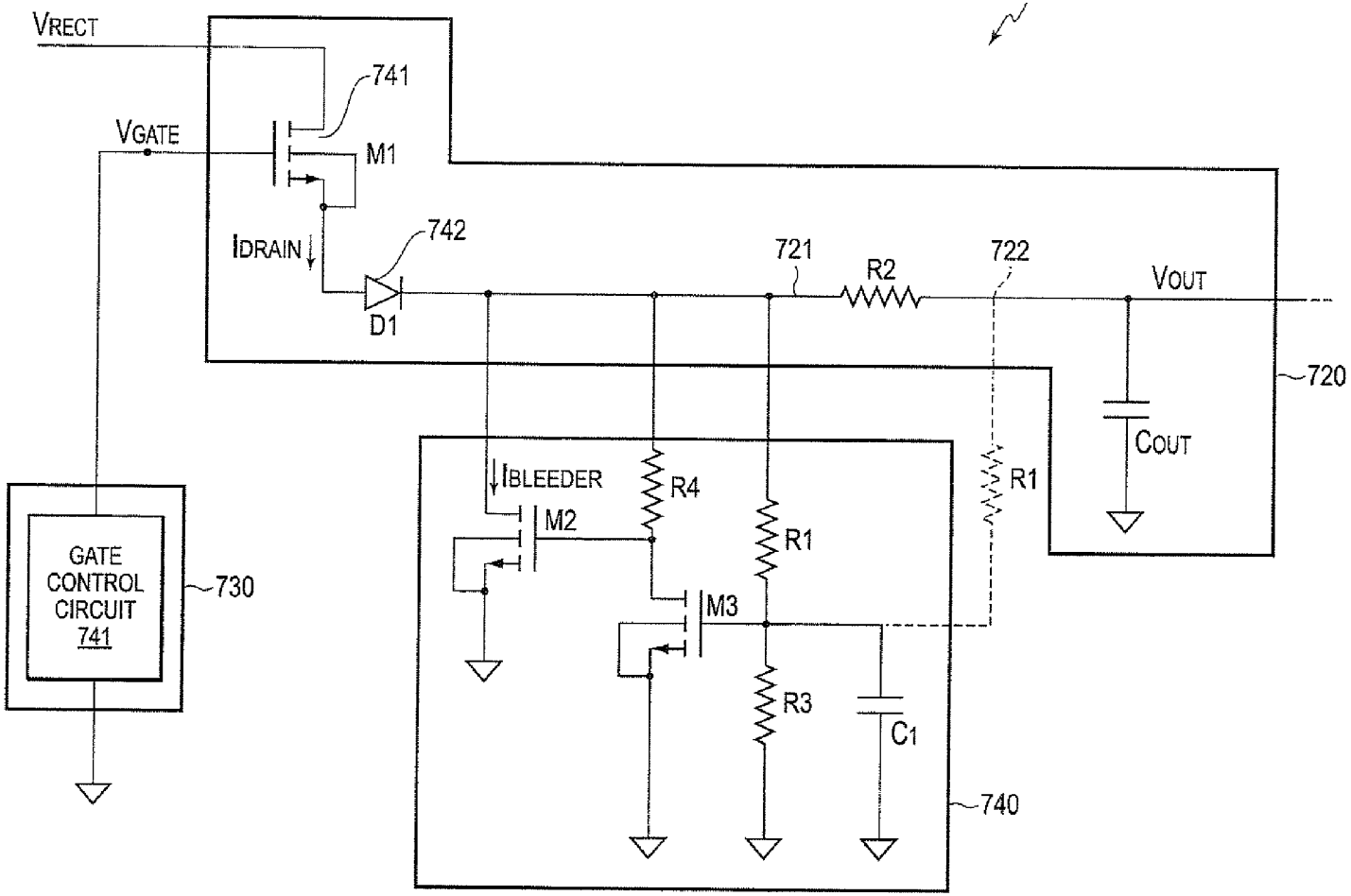
FIG. 7 shows a block diagram of a circuit example 710 according to an embodiment of the disclosure.

FIG. 7 shows a block diagram of a circuit example 710 according to an embodiment of the disclosure. The circuit example 710 utilizes certain components that are identical or equivalent to those used in the circuit 410; the description of these components has been provided above and will be omitted here for clarity purposes. In this embodiment, the control circuit 730 does not include a return path control circuit to control the return path circuit 740, and the return path circuit 740 is self-controlled.

The return path circuit 740 includes transistors M2 and M3, resistors R1, R3 and R4 and a capacitor C1. These elements are coupled together as shown in FIG. 7. The resistors R1 and R3 and the capacitor C1 form an RC circuit to determine a turn-on time of the transistor M2. According to an embodiment of the disclosure, the turn on time T can be expressed by Eq. 1:

$$T = \frac{R1 \times R_3}{R1 + R_3} \times C_1 \qquad \text{Eq. 1}$$

During operation, in an example, when the dimmer 102 is turned on, the output voltage $V_{OUT}$ is maintained at a relatively high level, such as above 10V. The resistance ratio of the resistors R1 and R3 are suitably determined that the gate voltage of the transistor M3 is above its threshold, thus the transistor M3 is turned on to pull down the gate voltage of the transistor M2, thus the transistor M2 is turned off.

When the dimmer 102 is turned off, the output voltage $V_{OUT}$ drops. When the output voltage $V_{OUT}$ drops to a level that the gate voltage of the transistor M3 is below its threshold, the transistor M3 is turned off. The resistor R4 pulls up the gate voltage of the transistor M2 to a relatively high level to turn on the transistor M2. In an example, the transistor M2 stays on for about the turn on time T, and then the gate voltage of the transistor M2 is below its threshold voltage and the transistor M2 is turned off.

It is noted that the circuit 710 can be suitably modified. For example, the resistor R1 can be connected to node 721 or can be connected to node 722.

Figure 8:
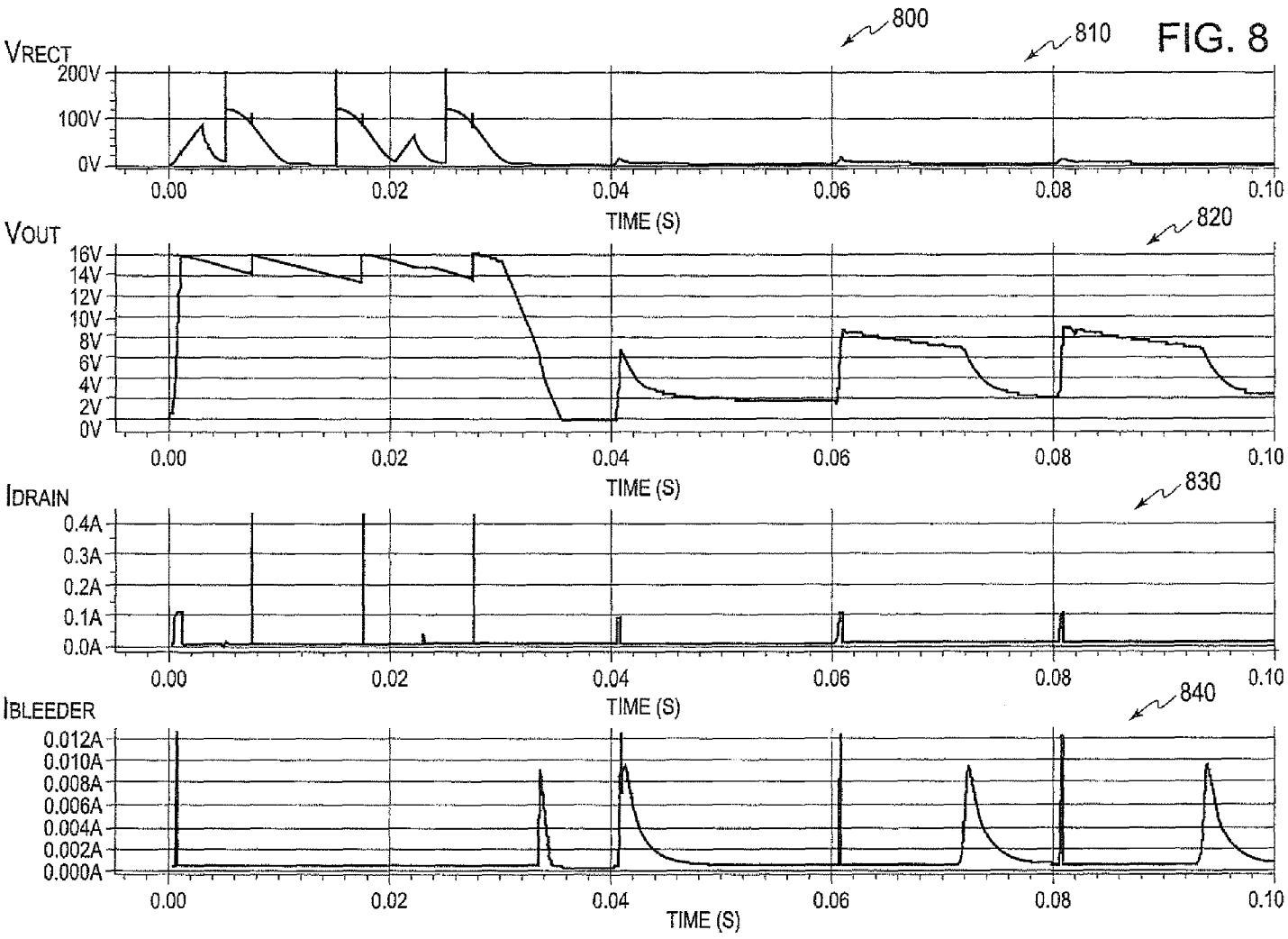
FIG. 8 shows a plot 800 of waveforms according to an embodiment of the disclosure.

FIG. 8 shows a plot 800 of waveforms for the circuit 710 when the dimmer 102 is switched from being turned on to being turned off according to an embodiment of the disclosure. The plot 800 includes a first waveform 810 for the rectified voltage $V_{RECT}$, a second waveform 820 for the output voltage $V_{OUT}$, a third waveform 830 for the drain current $I_{DRAIN}$ of the transistor M1, and a fourth waveform 840 for the bleeding current $I_{BLEEDER}$ of the transistor M2.

In the FIG. 8 example, at about 0.03 seconds, the dimmer 102 is switched from being turned on to being turned off. According to an embodiment, before the dimmer 102 is switched off, the dimmer 102 regulates the output according to a first conduction angle that depends on the dimming angle of the dimmer 102, and a second conduction angle that is independent of the dimming angle. After the dimmer 102 is switched off, the first conduction angle does not exist, and the second conduction angle still exists at the beginning of each AC cycle.

As can be seen from the first waveform 810, before the dimmer 102 is switched off, during the first conduction angle and the second conduction angle, the rectified voltage $V_{RECT}$ follows the absolute value of the AC supply voltage.

Before the dimmer 102 is switched off, the control circuit 730 is in operation. As can be seen from the second waveform 820 and the third waveform 830, the gate control circuit 731 controls the transistor M1 to turn on/off to let the rectified voltage $V_{RECT}$ charge the capacitor $C_{OUT}$, and maintain the output voltage $V_{OUT}$ in a desired range, such as within [11V, 15V] range.

Before the dimmer 102 is switched off, because the output voltage $V_{OUT}$ is relatively high, and thus the gate voltage of the transistor M3 is larger than its threshold. The transistor M3 is turned on to pull down the gate voltage of the transistor M2. As can be seen from the fourth waveform 840, no bleeding current passes the transistor M2 before the dimmer 102 is switched off.

When the dimmer 102 is switched off, the first conduction angle does not exists, the rectified voltage $V_{RECT}$ is only non-zero during the second conduction angle (at the beginning of each AC cycle). The rectified voltage $V_{RECT}$ can no longer charge the capacitor $C_{OUT}$ to maintain the output voltage $V_{OUT}$, and thus the output voltage $V_{OUT}$ drops to relatively low level, such as below 10. Thus, during the second conduction angle, the output voltage $V_{OUT}$ increases due to the non-zero rectified voltage $V_{RECT}$, and then drops. When the output voltage $V_{OUT}$ is relatively large, the transistor M3 is turned on and thus the transistor M2 is turned off. When the output voltage $V_{OUT}$ drops to a level that the transistor M3 is turned off, the transistor M2 is turned on for the turn-on time T to form the return path.

Figure 9:
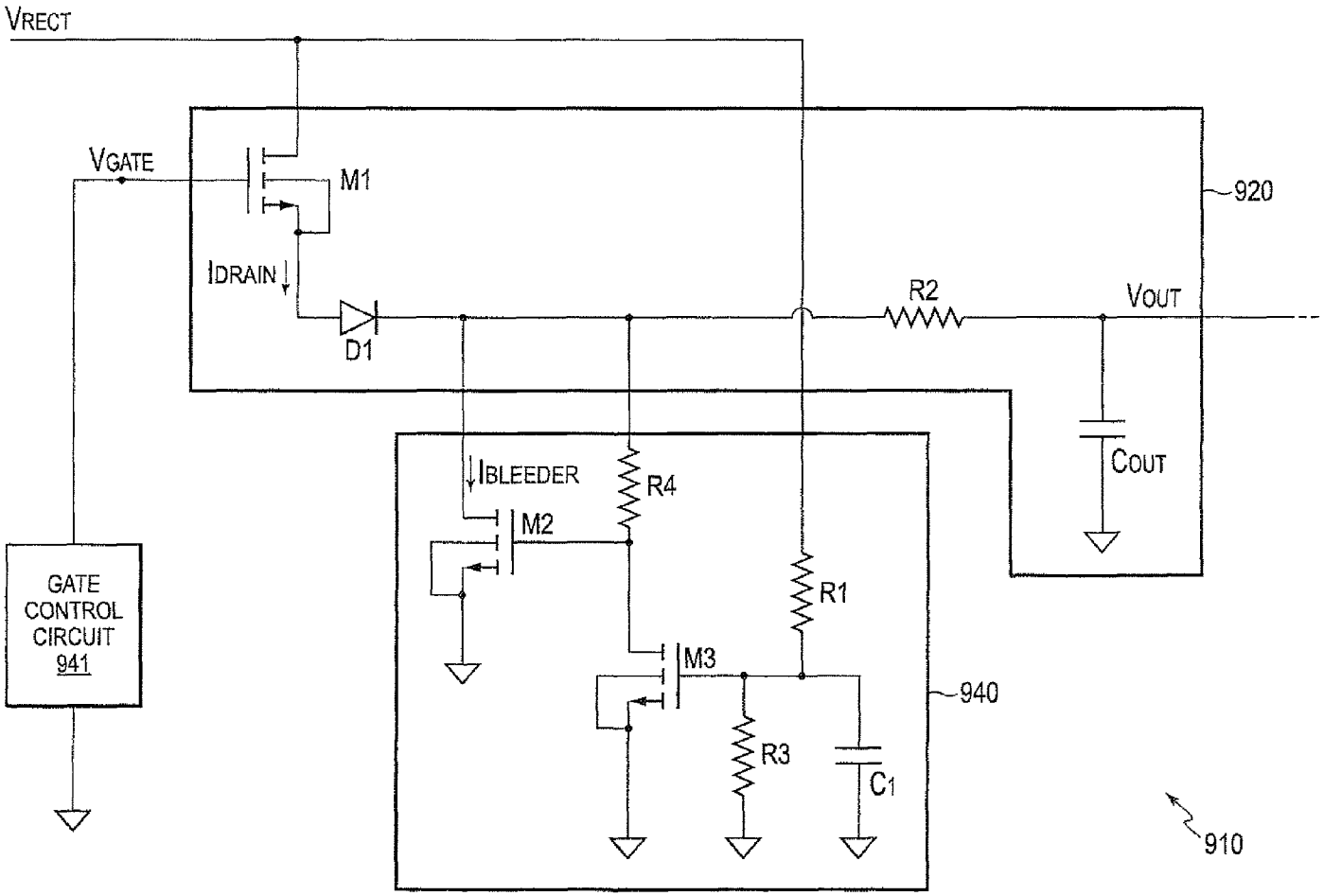
FIG. 9 shows a block diagram of a circuit example 910 according to the embodiment of the disclosure.

FIG. 9 shows a block diagram of a circuit example 910 according to the embodiment of the disclosure. The circuit example 910 also utilizes certain components that are identical or equivalent to those used in the circuit 710; the description of these components has been provided above and will be omitted here for clarity purposes. However, in this embodiment, the resistor R1 is coupled to the rectified voltage $V_{RECT}$ instead of the $V_{OUT}$.

Figure 10:
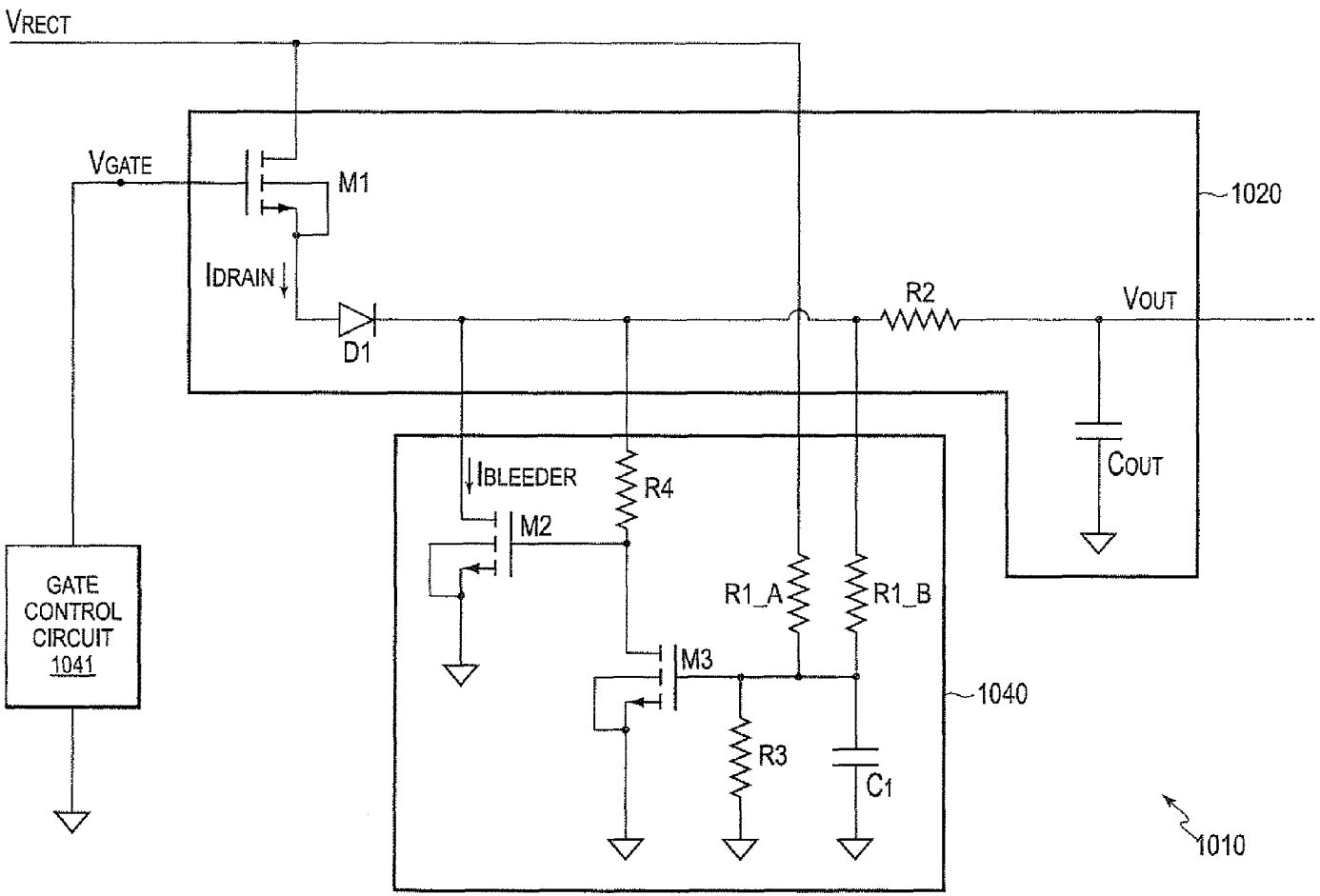
FIG. 10 shows a block diagram of a circuit example 1010 according to an embodiment of the disclosure.

FIG. 10 shows block diagram of a circuit example 1010 according to an embodiment of the disclosure. The circuit 1010 operates similarly to the circuit 710 and the circuit 910. The circuit 1010 also utilizes certain components that are identical or equivalent to those used in circuit 710 and circuit 910; the description of these components has been provided above and will be omitted here for clarity purposes. However, in this embodiment, a resistor R1_A is coupled to the rectified voltage $V_{RECT}$, and another resistor R1_B is coupled to the output voltage $V_{OUT}$.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. A circuit, comprising:

a dimmer receiving an Alternating Current (AC) power signal from an AC power supply, the dimmer configured to conduct during (i) a first conduction angle ranging from a dimming angle $\alpha$ to an end of a half cycle of the AC power signal and (ii) a second conduction angle ranging from a beginning of the half cycle of the AC power signal to an angle $\beta$, wherein $\alpha>\beta$;

a control circuit configured to operate to provide power to a first device when the dimmer coupled to the control circuit operates at the first conduction angle, the first conduction angle being adjusted to control an output power to the first device; and a return path circuit configured to provide a return path to provide power to a second device when the dimmer operates at the second conduction angle and the control circuit is not in operation, wherein the control circuit disables the return path when the control circuit is in operation.

2. The circuit of claim 1, wherein the control circuit further comprises:

a return path control circuit configured to disable the return path when the control circuit is in operation.

3. The circuit of claim 2, wherein the return path control circuit is configured to disable the return path based on at least one of an input voltage to the circuit and an output voltage of the circuit.

4. The circuit of claim 1, wherein the return path circuit is configured to provide the return path to enable providing power to the second device when the control circuit is not in operation.

5. The circuit of claim 4, wherein the return path circuit is configured to provide the return path to enable providing power to a remote control receiver when the control circuit is not in operation.

6. The circuit of claim 1, wherein the return path circuit includes a transistor configured to be turned on in response to the second conduction angle when the control circuit is not in operation.

7. The circuit of claim 6, wherein the return path circuit includes a resistor and a capacitor to determine a turn on time of the transistor.

8. The circuit of claim 1, further comprising:

a startup circuit configured to enable the control circuit to start operation in response to the first conduction angle.

9. An electronic system, comprising:

a dimmer receiving an Alternating Current (AC) power signal from an AC power supply, the dimmer configured to conduct during (i) a first conduction angle ranging from a dimming angle $\alpha$ to an end of a half cycle of the AC power signal and (ii) a second conduction angle ranging from a beginning of the half cycle of the AC power signal to an angle $\beta$, wherein $\alpha>\beta$; and a circuit coupled to the dimmer, the circuit including:

a control circuit configured to operate to provide power to a first device when the dimmer operates at the first conduction angle, the first conduction angle being adjusted to control an output power to the first device; and a return path circuit configured to provide a return path to provide power to a second device when the dimmer operates at the second conduction angle and the control circuit is not in operation, wherein the control circuit disables the return path when the control circuit is in operation.

10. The electronic system of claim 9, wherein the control circuit further comprises:

a return path control circuit configured to disable the return path when the control circuit is in operation.

11. The electronic system of claim 10, wherein the return path control circuit is configured to disable the return path based on at least one of an input voltage to the circuit and an output voltage of the circuit.

12. The electronic system of claim 9, wherein the dimmer includes the second device.

13. The electronic system of claim 12, wherein the second device is a remote control receiver.

14. The electronic system of claim 9, wherein the return path circuit includes a transistor configured to be turned on in response to the second conduction angle when the control circuit is not in operation.

15. The electronic system of claim 14, wherein the return path circuit includes a resistor and capacitor to determine a turn on time of the transistor.

16. The electronic system of claim 9, wherein the circuit further comprises:

a startup circuit configured to enable the control circuit to start operation in response to the first conduction angle.

17. A method, comprising:

receiving an input by a dimmer that is regulated to have a first conduction angle ranging from a dimming angle $\alpha$ to an end of a half cycle of an Alternating Current (AC) power signal and a second conduction angle ranging from a beginning of the half cycle of the AC power signal to an angle $\beta$, wherein $\alpha>\beta$, the first conduction angle being adjusted to control an output power to a first device, and the second conduction angle being independent of the control of the output power to the first device; and providing power to the first device only when the dimmer operates at the first conduction angle;

turning on a return path for the input during an operation of the dimmer only at the second conduction angle to provide power to a second device when the input provides no output power to the first device.

18. The method of claim 17, further comprising at least one of:

turning off the return path when the input is larger than a first threshold; and turning off the return path when a capacitor voltage on a capacitor is larger than a second threshold, the capacitor being charged based on the input.

* * * * *